US011073112B2

(12) United States Patent
Shinaberry et al.

(10) Patent No.: US 11,073,112 B2
(45) Date of Patent: Jul. 27, 2021

(54) EVAPORATIVE EMISSION CONTROL SYSTEM FOR A VEHICLE

(71) Applicant: Nissan North America, Inc., Franklin, TN (US)

(72) Inventors: Kyle Shinaberry, Garden City, MI (US); Mike Taylor, Farmington Hills, MI (US)

(73) Assignee: NISSAN NORTH AMERICA, INC., Franklin, TN (US)

( * ) Notice: Subject to any disclaimer, the term of this patent is extended or adjusted under 35 U.S.C. 154(b) by 0 days.

(21) Appl. No.: 16/524,842

(22) Filed: Jul. 29, 2019

(65) Prior Publication Data

US 2021/0033047 A1 Feb. 4, 2021

(51) Int. Cl.
*F02M 25/08* (2006.01)
*F02D 41/00* (2006.01)

(52) U.S. Cl.
CPC ..... *F02M 25/0818* (2013.01); *F02D 41/003* (2013.01); *F02M 25/089* (2013.01); *F02M 25/0836* (2013.01)

(58) Field of Classification Search
CPC ..... F02M 25/0818; F02M 25/0836; F02M 25/089; F02D 41/003
USPC ..... 123/519
See application file for complete search history.

(56) References Cited

U.S. PATENT DOCUMENTS

| | | | | |
|---|---|---|---|---|
| 5,641,899 | A | 6/1997 | Blomquist et al. | |
| 5,651,350 | A | 7/1997 | Blomquist et al. | |
| 2002/0162457 | A1* | 11/2002 | Hyodo | B01D 53/0454 96/109 |
| 2012/0215399 | A1 | 8/2012 | Jentz et al. | |
| 2015/0090006 | A1 | 4/2015 | Peters et al. | |
| 2015/0090235 | A1 | 4/2015 | Pearce et al. | |
| 2015/0121999 | A1* | 5/2015 | Dudar | F02M 25/089 73/114.39 |
| 2015/0159597 | A1 | 6/2015 | Woods et al. | |
| 2018/0171938 | A1* | 6/2018 | Watanabe | F02D 41/0037 |
| 2019/0078976 | A1 | 3/2019 | Nelson | |

FOREIGN PATENT DOCUMENTS

| | | | |
|---|---|---|---|
| CN | 102645308 | A | 8/2012 |
| DE | 102018122171 | A1 | 3/2019 |

* cited by examiner

*Primary Examiner* — Joseph J Dallo
*Assistant Examiner* — Scott A Reinbold
(74) *Attorney, Agent, or Firm* — Global IP Counselors, LLP

(57) ABSTRACT

An evaporative emission control system for a vehicle includes an engine, a fuel tank connected to the engine and a reversible purge pump connected between the fuel tank and the engine. Fuel vapor generated in the fuel tank is supplied to the engine. The purge pump is operable in a first direction to supply the fuel vapor from the fuel tank to the engine and a second direction to supply air to the fuel tank. A purge control valve is connected between the reversible purge pump and the engine to control a flow of the fuel vapor to the engine.

19 Claims, 3 Drawing Sheets

EVAPORATIVE EMISSION CONTROL SYSTEM FOR A VEHICLE

BACKGROUND

Field of the Invention

The present invention generally relates to a system and method of detecting a leak in an evaporative emission control system of a vehicle. More specifically, the present invention relates to a reversible purge pump connected between a fuel tank and an engine to facilitate detecting a leak in an evaporative emission control system.

Background Information

An evaporative emission control system of a vehicle prevents fuel vapors from escaping to the atmosphere. The evaporative emission control system is monitored to detect the presence of a leak in the evaporative emission control system. When a leak is detected, an indicator indicates the presence of the detected leak in the evaporative emission control system.

SUMMARY

An object of the disclosure is to provide an evaporative emission control system for a vehicle and a method for detecting a leak therein.

In view of the state of the known technology, one aspect of the present disclosure is to provide an evaporative emission control system for a vehicle including an engine, a fuel tank connected to the engine and a reversible purge pump connected between the fuel tank and the engine. Fuel vapor generated in the fuel tank is supplied to the engine. The purge pump is operable in a first direction to supply the fuel vapor from the fuel tank to the engine and a second direction to supply air to the fuel tank. A purge control valve is connected between the reversible purge pump and the engine to control a flow of the fuel vapor to the engine.

Another aspect of the present invention includes a method of detecting a leak in an evaporative emission control system of a vehicle. An initial pressure of the evaporative emission control system is detected. A purge control valve disposed between an engine and a canister of the evaporative emission control system is opened. A reversible purge pump disposed between the purge control valve and the canister is operated in the reverse direction to draw air into the fuel tank. A test pressure of the evaporative emission control system is detected after closing the purge control valve and stopping operation of the reversible purge pump. A presence of a leak in the evaporative emission control system is determined when the test pressure differs from the expected system pressure based on the initial pressure by more than a predetermined threshold.

Also other objects, features, aspects and advantages of the disclosed evaporative emission control system and method of detecting a leak therein will become apparent to those skilled in the art from the following detailed description, which, taken in conjunction with the annexed drawings, discloses exemplary embodiments of the evaporative emission control system for a vehicle and method for detecting a leak therein.

BRIEF DESCRIPTION OF THE DRAWINGS

Referring now to the attached drawings which form a part of this original disclosure.

DETAILED DESCRIPTION OF EXEMPLARY EMBODIMENTS

Selected embodiments will now be explained with reference to the drawings. It will be apparent to those skilled in the art from this disclosure that the following descriptions of the exemplary embodiments are provided for illustration only and not for the purpose of limiting the invention as defined by the appended claims and their equivalents.

Figure 1:
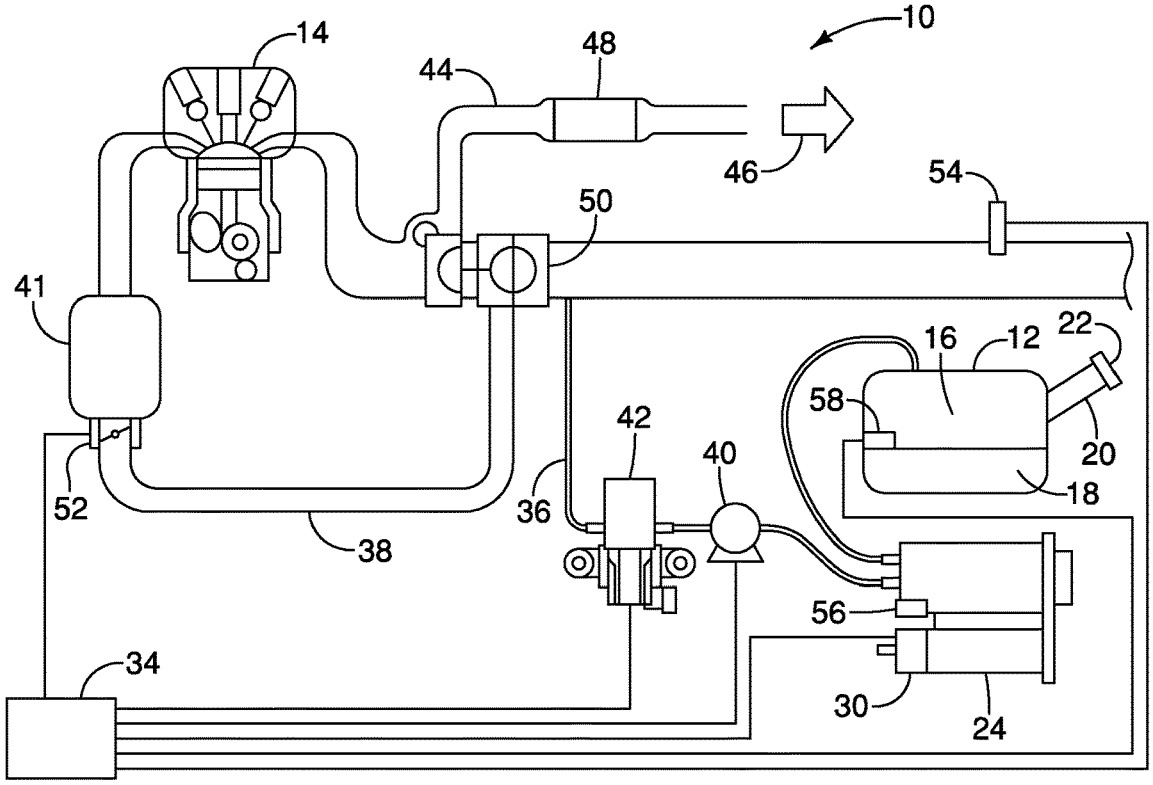
FIG. 1 is a schematic diagram of an evaporative emission control system in accordance with an exemplary embodiment of the present invention.
Figure 2:
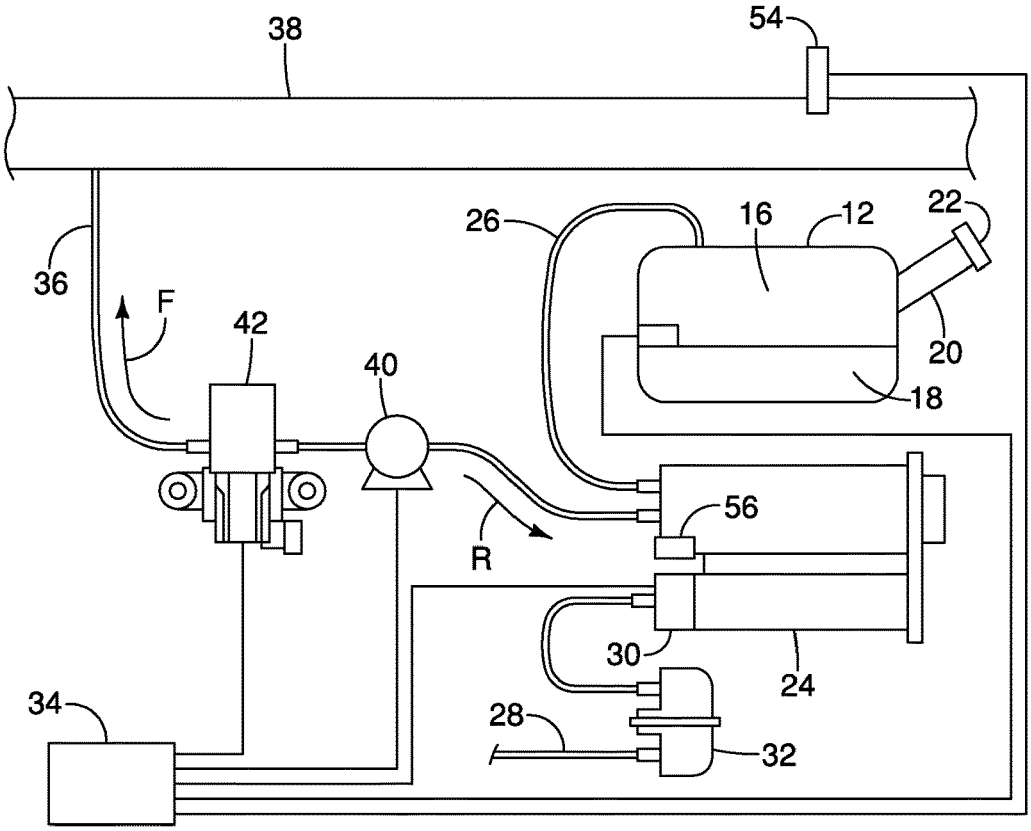
FIG. 2 is an enlarged view of a portion of the schematic diagram of the evaporative emission control system of FIG. 1.

Referring initially to FIGS. 1 and 2, an evaporative emission control system 10 is illustrated in accordance with an exemplary embodiment of the present invention. The evaporative emission control system 10 includes a fuel tank 12 connected to an engine 14 of the vehicle. The fuel tank 12 is in fluid communication with the engine 14 such that fuel vapor 16 produced in the fuel tank 12 is supplied to the engine 14 for combustion.

The fuel tank 12 stores liquid fuel 18 supplied to the fuel tank through the inlet pipe, or fuel filler neck, 20. A fuel cap 22 seals the inlet pipe 20 to prevent fuel vapors 16 produced in the fuel tank 12 from being exhausted to the atmosphere.

A fuel vapor canister 24 is an emissions control device fluidly connected to the fuel tank 12 by a conduit 26. The canister 24 includes an adsorbent, such as activated charcoal, to trap fuel vapor 16 from the fuel tank 12. Fuel vapor 16 is transmitted to the canister 24 during refilling of the fuel tank 12 and operation of the vehicle. A vent line 28 vents to the atmosphere from the canister 24. A vent control valve 30 is disposed in the vent line 28 to control the flow of air from and to the atmosphere through the vent line 28 to and from the canister 24. A filter 32, such as a trap-type filter, is disposed in the vent line 28 to keep dust and other debris from entering the evaporative emission control system 10 when drawing air in through the vent line 28. A controller 34, such as an engine computer (for example, a powertrain control module, or PCM), is electrically connected to the vent control valve 30 to control operation thereof.

A supply line 36 fluidly connects the canister 24 and an engine intake passage 38. A reversible purge pump 40 and a purge control valve 42 are disposed on the supply line 36 to control the flow of fuel vapor therethrough. The purge control valve 42 is disposed downstream of the reversible purge pump 40 with respect to the flow of fuel vapor from the canister 24 to the engine intake passage 38. The reversible purge pump 40 and the purge control valve 42 are electrically connected to the controller 34 such that the controller 34 can control operation of the reversible purge pump 40 and the purge control valve 42. The canister 24 is disposed between the fuel tank 12 and the reversible purge pump 40 to store the fuel vapor 16 exhausted from the fuel tank 12. The reversible purge pump 40 is disposed between the purge control valve 42 and the canister 24 on the supply line 36.

The engine intake passage 38 supplies vapor and air to an intake manifold 41 of the engine 14. An exhaust line 44 exhausts gases 46 from the engine 14 to the atmosphere. A catalytic converter 48 is fluidly connected to the exhaust line 44 to reduce gases and pollutants in the exhaust gas 46 from the engine 14. A turbocharger 50 is fluidly connected to the engine intake passage 38 and to the exhaust line 44, such that the exhaust gas 46 passing through the turbocharger 50 increases the pressure of the air in the engine intake passage 38 supplied to the engine 14 to increase the power of the engine 14.

A throttle valve 52 is disposed in the engine intake passage upstream of the intake manifold 41. The throttle valve 52 is electrically connected to the controller 34 to be controlled thereby. The position of the throttle valve 52 is controlled to control the fluid flow (i.e., the fuel vapor and air) therethrough. The throttle valve 52 can be disposed in a fully closed position to prevent fluid flow therethrough, in a fully open position to maximize fluid flow therethrough, and any position therebetween to control the volume of fluid passing therethrough.

A mass air flow sensor 54 is disposed in the engine intake passage 38 upstream of the throttle valve 52 and upstream of the turbocharger 50. Preferably, the mass air flow sensor 54 is disposed upstream of the connection of the supply line 36 to the engine intake passage 38. The mass air flow sensor 54 determines the mass of fluid flow through the engine intake passage 38. A signal is sent to the controller 34 from the mass air flow sensor 54 such that the controller 34 can control the amount of fuel injected in the engine 14.

To purge the fuel vapor in the canister 24, the controller 34 controls the canister vent control valve 30 and the purge control valve 42 to be open such that vacuum from the engine 14 draws the fuel vapor into the engine intake passage 38. The supply line 36 is preferably connected upstream of the turbocharger 50, such that the purged fuel vapor passes through the turbocharger 50 on the flow path to the engine 14 for burning. In other words, the fuel vapor 16 generated in the fuel tank 12 is supplied to the engine 14. The controller 34 connected to the purge control valve 42 is configured to open the purge control valve 42 to supply the fuel vapor from the canister 24 to the engine 14. With the canister vent control valve 30 open, air is drawn into the canister 24 through the vent line 28 to replace the purged fuel vapor and to mix with the fuel vapor supplied to the engine 14 for better combustion. The reversible purge pump 40 is operated by the controller 34 to facilitate supplying the fuel vapor to the engine 14.

The reversible purge pump 40 is operable in first and second directions. The reversible purge pump 40 is operable in the first, or forward, direction to supply the fuel vapor from the fuel tank 12 to engine 14. The fuel vapor flows in the direction F, as shown in FIG. 2, when the reversible purge pump 40 is operated in the first direction. The reversible purge pump 40 is operable in the second, or reverse, direction to conduct a leak test of the evaporative emission control system 10. When the reversible purge pump 40 is operated in the second direction, air is supplied to the fuel tank 12 to pressurize the fuel tank 12. The air flows in the direction R, as shown in FIG. 2, when the reversible purge pump 40 is operated in the second direction. The direction R of the air flow is opposite to the direction F of the fuel vapor flow.

A pressure sensor 56 is connected to the canister 24 to detect a pressure of the evaporative emission control system 10. A fuel level sensor 58 is disposed in the fuel tank 12 to detect a level of the fuel 18 within the fuel tank 12. The pressure sensor 56 and the fuel level sensor 58 are electrically connected to the controller 34 to transmit signals thereto regarding the pressure of the evaporative emission control system 10 and the fuel level of the fuel tank 12, respectively.

Figure 3:
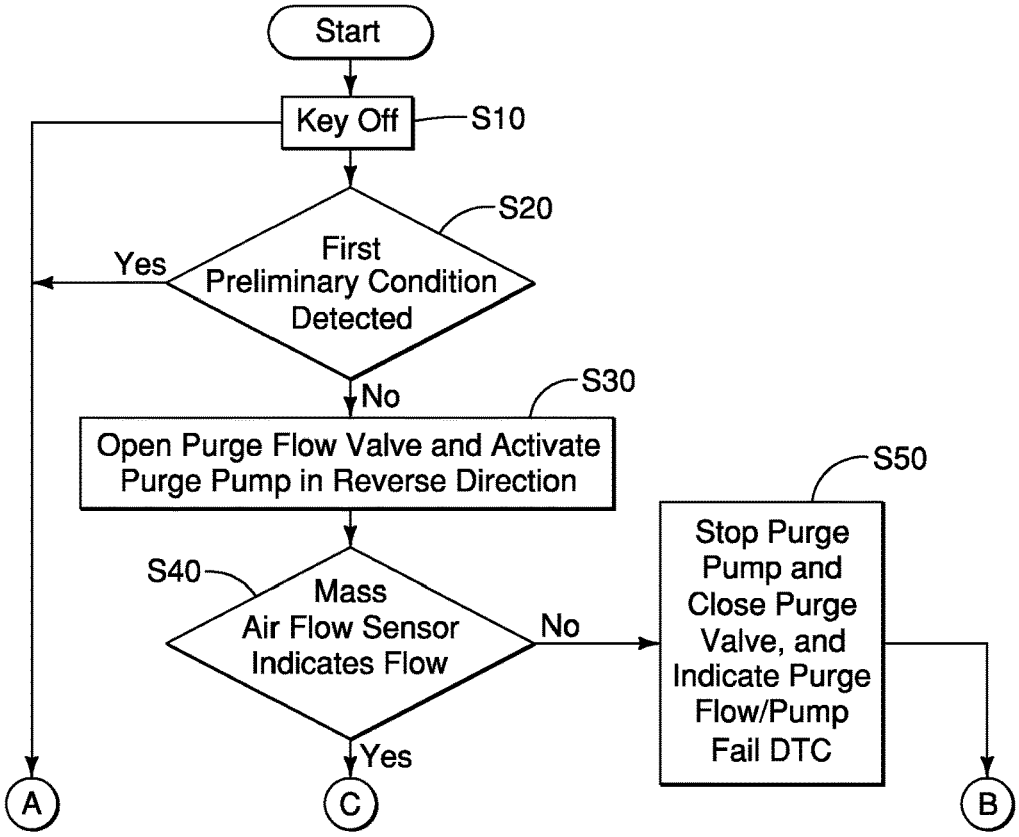
FIGS. 3-5 are flowcharts of a method of detecting a leak in the evaporative emission control system of FIGS. 1 and 2 in accordance with an exemplary embodiment of the present invention.
Figure 4:
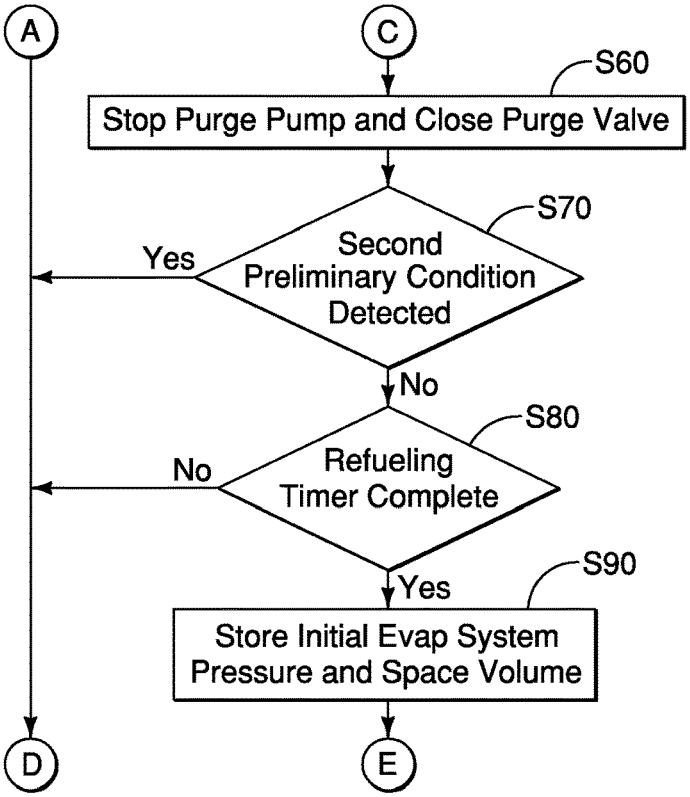
Figure 5:
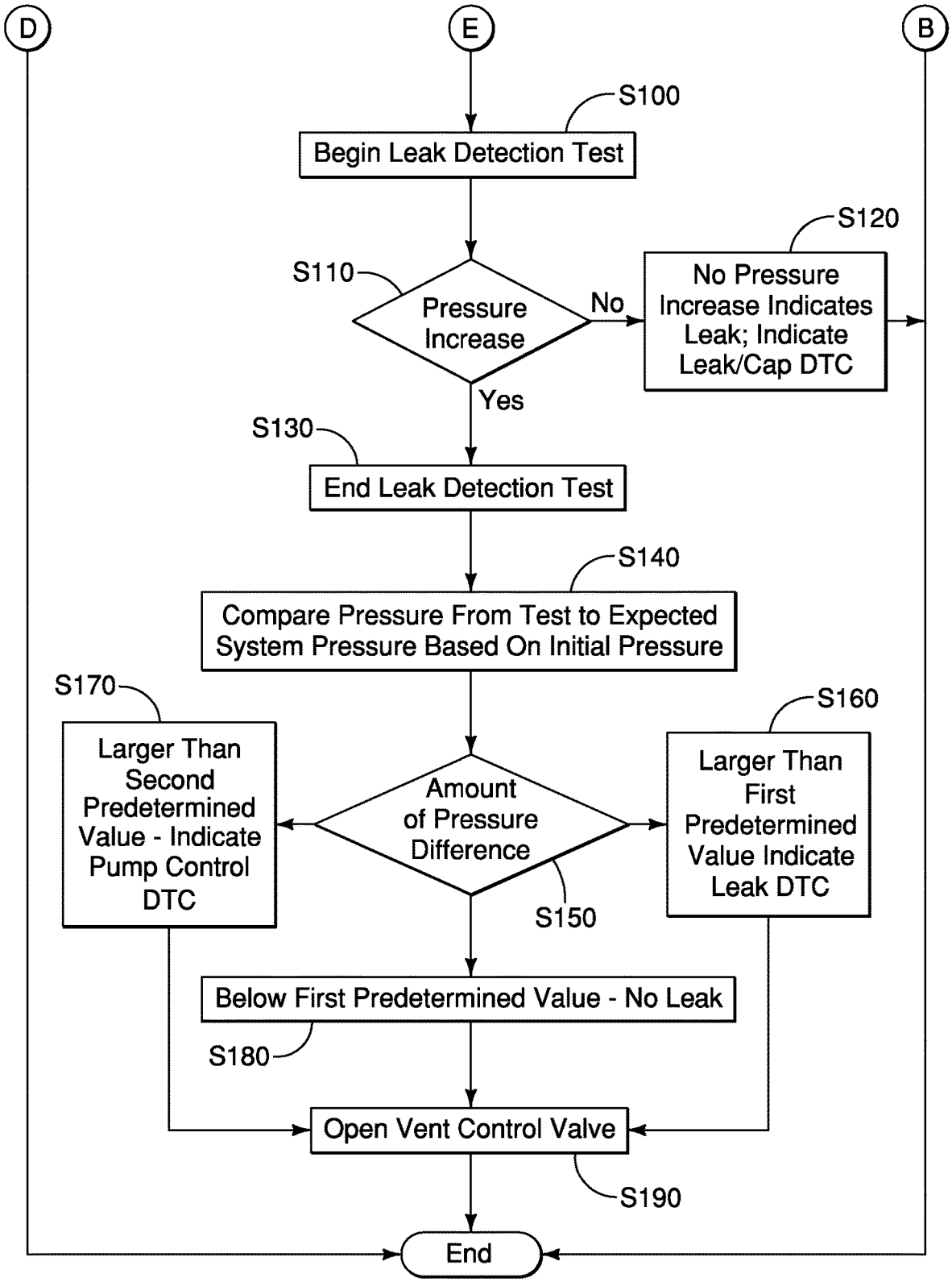

A method of detecting a leak in the evaporative emission control system 10 of a vehicle is shown in the flow charts of FIGS. 3-5. The method of detecting a leak in the evaporative emission control system 10 is initiated when the key is in an off position (a key off event), as shown in Step S10 of FIG. 3. When the key is in the off position, the engine 14 is not running such that the leak determination is performed when the vehicle engine 14 is not running.

The controller 34 determines whether a first preliminary condition is present in Step S20. The first preliminary condition includes whether a diagnostic trouble code exists for the mass air flow sensor 54, whether a diagnostic trouble code exists for the purge control valve 42, or whether a circuit fault exists for the reversible purge pump 40. When a diagnostic trouble code or a circuit fault is not detected with respect to the mass air flow sensor 54, the purge control valve 42, or the reversible purge pump 40, the process moves to Step S30. When a diagnostic trouble code or circuit fault is detected with respect to the mass air flow sensor 54, the purge control valve 42, or the reversible purge pump 40, the leak detection process ends, as shown in FIGS. 3-5. A detected problem with the mass air flow sensor 54, the purge control valve 42 or the reversible purge pump 40 negatively impacts the leak detection, such that the leak detection process is ended.

When a first preliminary condition is present, i.e., when a first preliminary condition is detected, the leak detection process ends, as shown in FIGS. 3-5. When a first preliminary condition is not present, i.e., a first preliminary condition is not detected, the process moves to Step S30 in which the purge control valve 42 is opened and the reversible purge pump 40 is activated to operate in the second direction. When the engine 14 is not running, the purge control valve 42 is in a closed position. The controller 34 transmits a signal to open the purge control valve 42. The controller 34 then sends a signal to activate the reversible purge pump 40 to operate in the second direction such that air flow is in the direction R as shown in FIG. 2.

The process then moves to Step S40 in which a determination is made whether the mass air flow sensor 54 indicates air flow. When the reversible purge pump 40 is operated in the second direction, air is drawn in from the engine intake passage 38 and passes by the mass air flow sensor 54. When the mass air flow sensor 54 does not detect air flow when the reversible purge pump 40 is running in the second direction, the process moves to Step S50. When the mass air flow sensor 54 detects air flow when the reversible purge pump 40 is running in the second direction, the process moves to Step S60.

In Step S50, when the mass air flow sensor 54 fails to detect air flow, the reversible purge pump 40 is stopped and the purge control valve 42 is closed. The mass air flow sensor 54 transmits a signal to the controller 34 that air flow is not detected. The controller 34 then transmits a signal to the reversible purge pump 40 to stop operation, and a signal to the purge control valve 42 to close. A diagnostic trouble code is generated, in a conventional manner, indicating a failure with the purge air flow and/or the reversible purge pump 40. A problem with the purge control valve 42, such as being stuck in the closed position, or the reversible purge pump 40 results in the mass air flow sensor 54 not detecting air flow, thereby generating this diagnostic trouble code. The leak detection process then ends, as shown in FIGS. 3 and 5.

In Step S60, as shown in FIG. 4, when the mass air flow sensor detects air flow, the reversible purge pump 40 is stopped and the purge control valve 42 is closed. The mass air flow sensor 54 transmits a signal to the controller 34 that air flow is detected. The controller 34 then transmits a signal to the reversible purge pump 40 to stop operation, and a signal to the purge control valve 42 to close.

The controller 34 then determines whether a second preliminary condition is present in Step S70. The second preliminary condition is different from the first preliminary condition. The second preliminary condition includes whether a diagnostic trouble code exists for the pressure sensor 56, whether a diagnostic trouble code exists for the canister vent control valve 30 (i.e., the EVAP output), whether a fuel level detected by the fuel level sensor 58 is between a predetermined lower limit and a predetermined upper limit, and whether the pressure of the evaporative emission control system 10 detected by the pressure sensor 56 is below a predetermined value. A fault with the pressure sensor 56 prevents accurately detected the evaporative emission control system pressure. A fault with the vent control valve 30 prevents the vent control valve 30 from being closed during the leak detection test or opened after the leak detection test is completed. The fuel level being between predetermined level and the initial pressure being below a predetermined lower limit ensure accurate measurements during the leak detection test. When a second preliminary condition is detected, the leak detection process ends, as shown in FIGS. 4 and 5. When a second preliminary condition is not detected, the leak detection process moves to Step S80.

In Step S80, the controller 34 determines whether the refueling timer is complete. When the refueling timer reaches a predetermined amount of time without an indication that refueling is taking place, the leak detection process moves to Step S90. When refueling is detected prior to the refueling timer reaching the predetermined amount of time, the leak detection process end, as shown in FIGS. 4 and 5. The predetermined amount of time can be any suitable time to determine whether refueling is occurring, such as, for example, ten minutes. Refueling can be determined by an increase in the evaporative emission control system 10 detected by the pressure sensor 56.

In Step S90, an initial pressure of the evaporative emission control system 10 and an initial space volume of the evaporative emission control system 10 are detected and recorded. The initial pressure and initial space volume are recorded in a memory of the controller 34. The pressure sensor 56 detects the initial pressure of the evaporative emission control system 10 and transmits the detected initial pressure to the controller 34 for recordation in the memory. The tank level sensor 58 determines the volume of the fuel 18 in the fuel tank 12 and transmits the detected fuel volume to the controller 34. The controller 34 calculates the initial space volume of the evaporative emission control system 10 based on the total vapor space of the fuel tank 12, the canister 24 and the supply line 26 minus the sensed fuel level of the fuel tank 12. The controller 34 records the initial space volume of the evaporative emission control system 10 in the memory.

The leak detection process then moves to Step S100 and begins the leak detection test, as shown in FIG. 5. To begin the leak detection test, the throttle valve 52 is closed to prevent air being drawn in from the engine 14. The canister vent control valve 30 is closed to prevent fresh air from being drawn in to the evaporative emission control system 10 through the vent line 28. The purge control valve 42 is opened to allow air flow from the engine intake passage 38 through the purge control valve 42, through the reversible purge pump 40, through the canister 24, and to the fuel tank 12. The reversible purge pump 40 is operated to run in the second direction such that the air flow is in the direction R (FIG. 2). The operation of the reversible purge pump 40 draws air from the engine intake passage 38, through the purge control valve 42, through the reversible purge pump 40, through the canister 24, and to the fuel tank 12, thereby pressurizing the evaporative emission control system 10. The evaporative emission control system 10 is pressurized to a specific absolute pressure, preferably to a pressure in the fuel tank 12 between four and six kPa (kilopascals), inclusive. The pumped air mass value, i.e., the amount of air pumped during the leak detection test, is transmitted to the controller 34 and stored in the memory. The pumped air mass is measured by the mass air flow sensor 54, with a temperature provided by an intake air sensor that is integrated with the mass air flow sensor 54 as a single component.

The leak detection process then moves to Step S110, in which the pressure sensor 56 determines whether there is a pressure increase in the evaporative emission control system 10. When no increase in the pressure of the evaporative emission control system 10 is determined by the pressure sensor 56, the process moves to Step S120. When an increase in the pressure of the evaporative emission control system 10 is determined by the pressure sensor 56, the process moves to Step S130.

In Step S120, the determination that there is not an increase in the pressure of the evaporative emission control system 10 indicates a leak in the evaporative emission control system 10. A leak in the evaporative emission control system 10 allows the pumped air to escape such that the system pressure does not increase. Alternatively, a determination that there is no pressure increase can result from a faulty fuel cap 22 (FIGS. 1 and 2) that does not properly seal the fuel tank 12, thereby allowing the pumped air to escape the fuel tank 12 and preventing the evaporative emission control system from being pressurized. Accordingly, a diagnostic trouble code is generated and stored in the controller memory indicating a leak in the evaporative emission control system 10. Additionally, a diagnostic trouble code is generated indicating a fault with the fuel cap 22. An alert can be provided to the driver indicating a leak in the evaporative emission control system 10 and/or a fault with the fuel cap 22, such as an indicator illuminated in the instrument cluster. The leak detection process then ends, as shown in FIG. 5.

In Step S130, the leak detection test is ended. As described above, the leak detection test ends when the system pressure reaches a predetermined absolute pressure. The controller 34 transmits a signal to stop operation of the reversible purge pump 40 and a signal to close the purge control valve 42. The pressure of the evaporative emission control system 10 detected by the pressure sensor 56 is transmitted to the controller 34 for recordation.

The leak detection process then moves to Step S140 in which the pressure detected in Step S130 from the leak detection test is compared to the expected calculated pressure based on the initial pressure detected in Step S90. The expected pressure change is calculated by the controller 34 based on the pumped air mass from Step S100 and the initial space volume of the evaporative emission control system 10 from Step S90. The expected pressure change is added to the initial pressure detected in Step S90 to obtain the expected evaporative emission control system pressure.

The leak detection process then moves to Step S150, in which a pressure difference between the test pressure from Step S130 and the expected system pressure from Step S140 is calculated. The leak detection process moves to one of Steps S160, S170 and S180 based on the calculated pressure difference.

When the calculated pressure difference is larger than a first predetermined value and smaller than a second predetermined value, the leak detection process moves to Step S160 in which a diagnostic trouble code is generated, in a conventional manner, indicating a leak in the evaporative emission control system 10. In other words, the pressure difference differs from the expected pressure by more than a predetermined threshold. Additionally, an alert can be provided to the driver indicating a leak in the evaporative emission control system 10, such as an indicator illuminated in the instrument cluster. The leak detection process then moves to Step S190, as shown in FIG. 5.

When the calculated pressure difference is larger than a second predetermined value, the leak detection process moves to Step S170 in which a diagnostic trouble code is generated, in a conventional manner, indicating a fault with control of the reversible purge pump 40. The large pressure difference is indicative of an issue with the reversible purge pump 40, such as the reversible purge pump 40 running longer than expected. For example, the reversible purge pump 40 does not stop running when the predetermined absolute system pressure is reached, thereby continuing to increase the system pressure. Step S170 is indicates overpressurization of the evaporative emission control system 10. The second predetermined value is larger than the first predetermined value. The first and second predetermined values for the pressure difference vary from vehicle to vehicle and are based on the specific vehicle and tank size. The leak detection process then moves to Step S190, as shown in FIG. 5.

When the calculated pressure difference is less than the first predetermined value, the leak detection process moves to Step S180, which indicates that there is not a leak in the evaporative emission control system 10 because the test pressure is within a predetermined threshold of the expected system pressure. The leak detection process then moves to Step S190, as shown in FIG. 5.

In Step S190, the vent control valve 30 is opened to relieve the system pressure. The controller 34 sends a signal to the vent control valve 30 to open. The vent control valve 30 was closed in Step S100 to facilitate pressurizing the evaporative emission control system 10 during the leak detection test. The leak detection process then ends, as shown in FIG. 5.

Alternatively, a leak in the evaporative emission control system 10 is not indicated until a result indicating a leak is obtained by the leak detection process on two separate occasions. In other words, the leak detection process indicating a leak during two different leak detection tests conducted during two different key off events in which the engine is not running is required before a leak is indicated.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment(s), the following directional terms "forward", "rearward", "above", "downward", "vertical", "horizontal", "below" and "transverse" as well as any other similar directional terms refer to those directions of a vehicle equipped with the evaporative emission control system for a vehicle. Accordingly, these terms, as utilized to describe the present invention should be interpreted relative to a vehicle equipped with the evaporative emission control system for a vehicle.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the exemplary embodiments according to the present invention are provided for illustration only, and not for the purpose of limiting the invention as defined by the appended claims and their equivalents.

What is claimed is:

1. An evaporative emission control system for a vehicle, comprising:

an engine;

a fuel tank connected to the engine, fuel vapor generated in the fuel tank being supplied to the engine;

a reversible purge pump connected between the fuel tank and the engine, the reversible purge pump being operable in a first direction to supply the fuel vapor from the fuel tank to the engine and a second direction to supply air to the fuel tank;

a purge control valve connected between the reversible purge pump and the engine to control a flow of the fuel vapor to the engine; and a mass air flow sensor disposed in an engine intake, a fault with the reversible purge pump or the purge control valve being detected when the mass air flow sensor does not detect air flow when the reversible purge pump is operated in the second direction.

2. The evaporative emission control system according to claim 1, wherein a canister is disposed between the fuel tank and the reversible purge pump to store the fuel vapor exhausted from the fuel tank.

3. The evaporative emission control system according to claim 2, wherein a controller connected to the purge control valve is configured to open the purge control valve to supply the fuel vapor from the canister to the engine.

4. The evaporative emission control system according to claim 2, wherein a pressure sensor is connected to the canister to determine a pressure of the evaporative emission control system.

5. The evaporative emission control system according to claim 2, wherein the reversible purge pump is disposed between the purge control valve and the canister.

6. The evaporative emission control system according to claim 2, wherein the reversible purge pump is operated in the second direction to conduct an evaporative emission control system leak test.

7. The evaporative emission control system according to claim 6, wherein a leak is detected when the pressure sensor does not detect a pressure increase when the reversible purge pump is operated in the second direction.

8. The evaporative emission control system according to claim 6, wherein a leak is detected when the pressure sensor detects a pressure difference that is less than a predetermined value when the reversible purge pump is operated in the second direction.

9. A method of detecting a leak in an evaporative emission control system of a vehicle, comprising the steps of detecting an initial pressure of the evaporative emission control system, opening a purge control valve disposed between an engine and a canister of the evaporative emission control system, operating a reversible purge pump disposed between the purge control valve and the canister in a reverse direction to draw air into the fuel tank, detecting a test pressure of the evaporative emission control system after closing the purge control valve and stopping operation of the reversible purge pump, determining a presence of a leak in the evaporative emission control system when the test pressure differs from an expected system pressure based on the initial pressure by more than a predetermined threshold, prior to detecting the initial pressure of the evaporative emission control system, the purge control valve is opened and the reversible purge pump is run in the reverse direction, and determining a fault with the reversible purge pump or the purge control valve when a mass air flow sensor disposed in an engine intake does not detect air flow when the reversible pump is running in the reverse direction.

10. The method of detecting a leak in an evaporative emission control system according to claim 9, wherein the leak determination is performed when a vehicle engine is not running.

11. The method of detecting a leak in an evaporative emission control system according to claim 9, wherein the leak determination is not performed when the vehicle is being refueled.

12. The method of detecting a leak in an evaporative emission control system according to claim 9, further comprising prior to detecting the initial pressure of the evaporative emission control system, the fuel level of the fuel tank is detected.

13. The method of detecting a leak in an evaporative emission control system according to claim 12, wherein the initial pressure is not detected when the fuel level is not within a predetermined range.

14. The method of detecting a leak in an evaporative emission control system according to claim 9, further comprising prior to detecting the test pressure of the evaporative emission control system, the presence of a leak is indicated when a pressure rise in the evaporative emission control system is not detected.

15. The method of detecting a leak in an evaporative emission control system according to claim 12, further comprising when the detected test pressure is within the predetermined threshold from the expected system pressure, a vent control valve is opened to relieve a pressure of the evaporative emission control system.

16. The method of detecting a leak in an evaporative emission control system according to claim 9, further comprising after detecting the test pressure, the purge control valve is closed and operation of the reversible purge pump is stopped.

17. The method of detecting a leak in an evaporative emission control system according to claim 9, further comprising the reversible purge pump is configured to be operated in a direction opposite to the reverse direction to draw fuel vapor from the fuel tank.

18. The method of detecting a leak in an evaporative emission control system according to claim 10, further comprising the presence of the leak is indicated when the test pressure differs from the expected system pressure by more than the predetermined threshold on two separate occasions when the engine is not running.

19. An evaporative emission control system for a vehicle, comprising:

an engine;

a fuel tank connected to the engine, fuel vapor generated in the fuel tank being supplied to the engine;

a reversible purge pump connected between the fuel tank and the engine, the reversible purge pump being operable in a first direction to supply the fuel vapor from the fuel tank to the engine and a second direction to supply air to the fuel tank;

a purge control valve connected between the reversible purge pump and the engine to control a flow of the fuel vapor to the engine; and a canister is disposed between the fuel tank and the reversible purge pump to store the fuel vapor exhausted from the fuel tank;

the reversible purge pump being operated in the second direction to conduct an evaporative emission control system leak test, a leak being detected when the pressure sensor does not detect a pressure increase when the reversible purge pump is operated in the second direction.

* * * * *